United States Patent [19]

Lundren

[11] 4,293,773

[45] Oct. 6, 1981

[54] METHOD FOR CONTAINING SPENT NUCLEAR FUEL RODS IN A PROTECTIVE CONTAINER TO FACILITATE DISPOSAL

[75] Inventor: Jan Lundren, Robertsfors, Sweden

[73] Assignee: ASEA Aktiebolag, Vesteras, Sweden

[21] Appl. No.: 903,946

[22] Filed: May 8, 1978

[30] Foreign Application Priority Data

May 10, 1977 [SE] Sweden ..... 7705417

[51] Int. Cl.[3] ..... G21F 5/00

[52] U.S. Cl. ..... 250/506; 53/116; 53/429; 206/278

[58] Field of Search ..... 53/116, 429; 206/278; 250/506, 507

[56] References Cited

U.S. PATENT DOCUMENTS

| | | | |
|---|---|---|---|
| 2,194,451 | 3/1940 | Soubier | 53/429 |
| 3,230,373 | 1/1966 | Montgomery | 250/507 |
| 3,811,543 | 5/1974 | Parrochia | 206/278 |

*Primary Examiner*—Harold A. Dixon

*Attorney, Agent, or Firm*—Watson, Cole, Grindle & Watson

[57] ABSTRACT

Disclosed is a method for preventing the scattering of radioactive material in spent nuclear fuel rods into the environment. The method comprises placing one or more of the spent fuel rods within a casing of ductile material, sealing the casing gas-tight, bending the casing so that its largest dimension is reduced, and placing a number of the bent casings within a protective container.

3 Claims, 8 Drawing Figures

METHOD FOR CONTAINING SPENT NUCLEAR FUEL RODS IN A PROTECTIVE CONTAINER TO FACILITATE DISPOSAL

BACKGROUND OF THE INVENTION

The present invention is directed to a method for containing spent nuclear fuel rods in protective containers so as to facilitate disposal of the fuel rods.

U.S. Pat. application Ser. No. 860,557 now U.S. Pat. No. 4,209,420 describes how used or spent nuclear fuel rods can be contained in protective containers for final disposal of the spent fuel rods, the containers preferably being placed in rock cavities or other spaces below the ground surface.

Nuclear fuel rods have substantial lengths, usually about 4 meters. It is desirable to limit the length of protective containers for these rods to less than the length of the rods due to the considerations of the manufacture of the ceramic protective containers, reduction in stresses in handling the protective containers and minimizing damage to the containers in case of movements in rock after disposal.

One solution is to cut the fuel rods into shorter lengths. This solution, however, leads to the disappearance of the protective barrier on the fuel rods. Thus, gaseous fission products contained in the cladding tubes of the rods must be taken care of in a safe manner. In addition, the risk of the spread of fission products formed during storage is also increased.

Another solution is to bend the fuel rods prior to containment. However, the cladding material of the rods has insufficient ductility to completely avoid fractures and therefore fission products may be released. Thus, this solution also necessitates measures for taking care of the fission products.

SUMMARY OF THE INVENTION

According to the present invention, one or more fuel rods are placed within a casing of very ductile material, whereafter the casing is sealed and then bent so that its largest dimension is reduced. A number of fuel rod casings, each formed through the bending operation, are then placed in protective container in a known manner. These protective containers are then deposited in a safe manner below or above the ground.

More particularly, a number of fuel rods are suitably placed in several layers in a flat casing. After sealing, the casing is bent 180° perpendicularly to the longitudinal axis in one or more places so that a flat package is formed. Depending on at how many places the casing is bent, a package is obtained which has a length of approximately one-half, one-third, etc., of the length of the fuel rods. These packages are then positioned in a protective container.

Preferably, the casing is bent in the middle into a U-shape such that the distance between the legs of the U-shape is one or twice the thickness of the casing. Such U-shaped casings are then brought together in pairs or groups with one leg extending between the legs of the other casing, whereafter they are placed in the protective container. The bending radius of such a U-shape is relatively great so that the contained fuel element cladding tubes at the very worst will not break during the bending.

The purpose of the casing is to prevent fission products from spreading during management. Casings with different widths may be used so as to utilize the volume of the protective container in the most advantageous manner. In addition, the casing can be constructed with one or more portions such as a bellows to facilitate the bending of the casing. It is also possible to form the flat casing into a roll with a suitable diameter. It is further possible to contain a whole fuel element or a fuel bundle within a single casing. In that case, however, it will be more difficult to bend the casing with its contents than if a heavy, flat casing is used. Steel, stainless steel, copper, titanium and other metals or alloys with excellent ductile properties and high strength and density properties may be used as the material for the casing.

DESCRIPTION OF THE DRAWING

The invention will be described in greater detail with reference to the accompanying drawings.

In the drawing.

DETAILED DESCRIPTION OF THE PREFERRED EMBODIMENT

In the figures, a number of fuel rods 1 are placed in one layer within a flat casing 2 which is sealed by a bottom 3 at its lower end. After filling casing 2 with rods 1, the upper end of the casing is sealed in a gas-tight manner by a lid 4 joined to the walls of the casing by welding. It is also possible to seal the casing 2 by flattening the ends of the casing and joining the walls together by a welded seam. The thickness of the casing 2 will then be somewhat larger than the diameter of the fuel rods plus the thickness of the material in the casing. The dimensions of fuel rods 1 normally used nowadays therefore result in a length of the casing 2 of about 4 meters and a thickness of about 15 millimeters. The width of casing 2 is varied to utilize the volume within a protective container in the best possible way.

Figure 1:
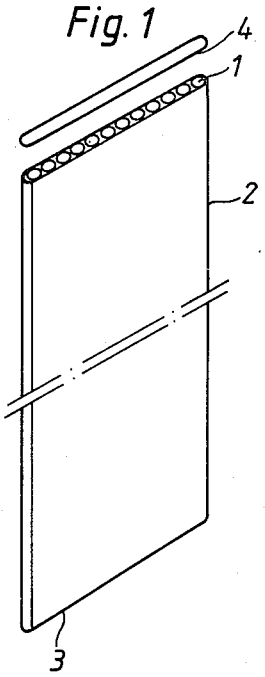
FIG. 1 shows a section through a flat casing for a number of fuel rods.
Figure 3:
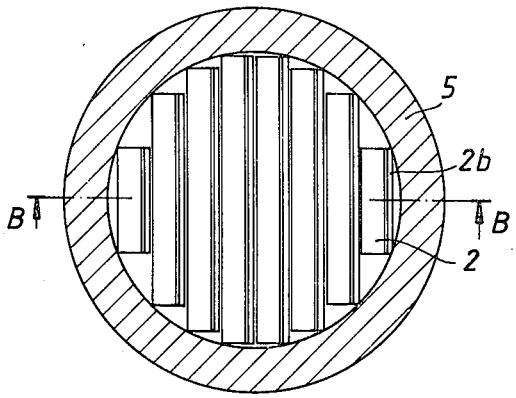
FIGS. 3 and 4 illustrate sections through a protective container in which a number of U-shaped casings with fuel elements are placed.
Figure 2:
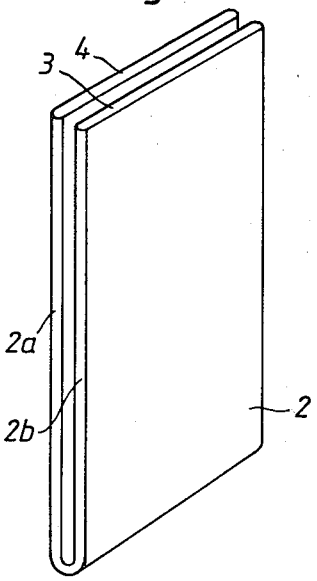
FIG. 2 shows a casing bent to form a U-shape.
Figure 4:
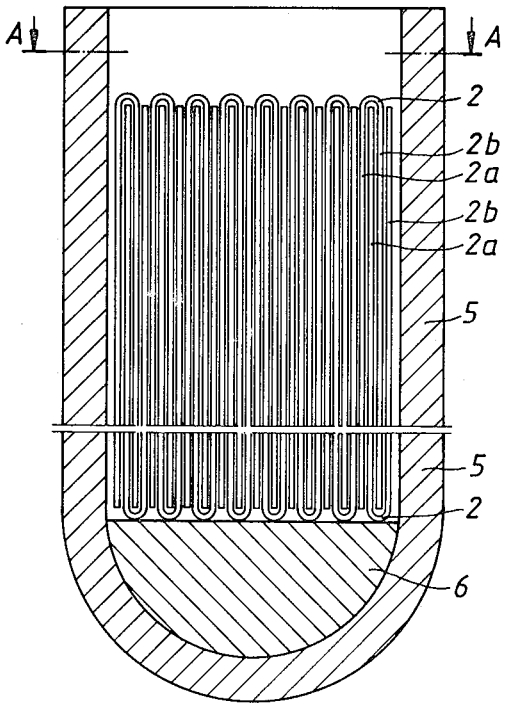

FIG. 2 shows a fuel rod casing 2 bent into a U-shape. The bending is carried out such that the distance between legs 2*a* and 2*b* is sufficiently large that a leg of another bent casing can be placed between the legs as is shown in FIGS. 3 and 4. FIG. 3 is a section A—A perpendicular to the longitudinal axis of a protective container 5 shown in FIG. 4, and FIG. 4 is a longitudinal section B—B through a protective container 5 shown in FIG. 3. A filling portion 6 is located at the lower part of the protective container 5, casings 2 being placed on said portion 6. As is clearly illustrated in FIG. 3, casings 2 of different widths are used for maximum utilization of the space within the protective container 5. The casings 2 can also be positioned in other ways for maximum utilization of the space. Protective container 5 is sealed in a known manner by a lid which is permanently joined to the container by means of sintering and hot pressing, this means being described in more detail in the above-mentioned U.S. Pat. application Ser. No. 860,557 now U.S. Pat. No. 4,209,420.

Figure 5:
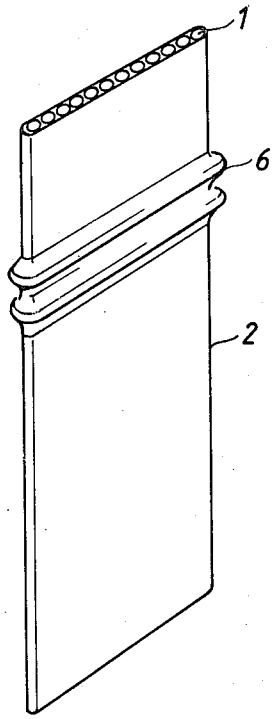
FIG. 5 shows a casing with a bellows portion which facilitates the bending of the casing.
Figure 6:
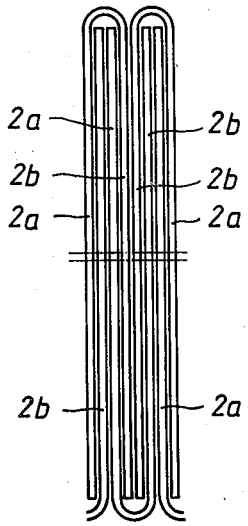
FIGS. 6, 7 and 8 show alternative possibilities of bending and placing the casings within the protective container.
Figure 7:
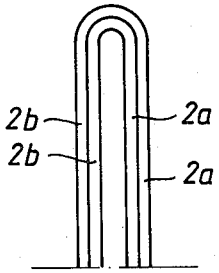
Figure 8:
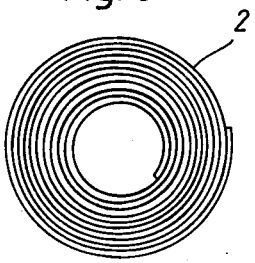

FIG. 5 shows a casing 2 provided with a bellows portion 6 at the location of bending. The bending of the casing 5 is facilitated by using this bellows portion 6 as the stresses in the casing material are limited, thus reducing the risk of a fracture with resultant leaks. FIGS. 6 and 7 show alternative methods for bending casings with contained fuel rods into a U-shape and placing them in relation to each other within the protective containers. FIG. 8 illustrates how a casing may be shaped into a roll.

While there has been shown and described what is considered to be preferred embodiments of the present invention, it will be obvious to those skilled in the art that various changes and modifications may be made therein without departing from the invention as defined in the appended claims.

I claim:

1. A method for preventing the scattering of radioactive material in spent nuclear fuel rods in the environment comprising (a) placing one or more of the fuel rods within a casing of ductile metal, (b) sealing the casing so as to be gastight, (c) bending the casing into a U-shape such that the distance between the legs of the U-shape is equal to or somewhat greater than the thickness of the casing, and (d) placing a number of the bent U-shaped casings within a protective container such that a leg of each casing extends between the legs of another casing.

2. A method for preventing the scattering of radioactive material in spent nuclear fuel rods in the environment comprising (a) placing one or more of the fuel rods within each of a number of casings formed of a ductile metal and having different widths, (b) sealing the casings so as to be gas-tight (c) bending the casings so that their largest dimensions are reduced, and (d) placing the casings within a protective container having a circular cross-section.

3. A method for preventing the scattering of radioactive material in spent nuclear fuel rods in the environment comprising (a) placing one or more of the fuel rods in a casing of ductile material, the casing having a bellows portion to facilitate its bending, (b) sealing the casing so as to be gas-tight, (c) bending the casing about its bellows portion so that its largest dimension is reduced, and (d) placing a number of the bent casings within a protective container.

* * * * *